United States Patent [19]

Lee

[11] 4,066,160

[45] Jan. 3, 1978

[54] SINGLE ELEMENT IMPRINTING ASSEMBLY WITH INERTIALLY AND KINEMATICALLY INDEPENDENT MOTION CONTROLS

[76] Inventor: Kuo-Liang Lee, Northgate Apts., 109H, Cranbury, N.J. 08512

[21] Appl. No.: 667,781

[22] Filed: Mar. 17, 1976

[51] Int. Cl.[2] ..... B41J 1/60

[52] U.S. Cl. ..... 197/18; 197/50; 197/55; 197/82; 197/127 R

[58] Field of Search ..... 197/16, 18, 50, 52, 197/53, 54, 55, 82, 114 R, 127 R, 133 R

[56] References Cited

U.S. PATENT DOCUMENTS

| | | | |
|---|---|---|---|
| 631,833 | 8/1899 | Treadgold | 197/55 |
| 3,389,774 | 6/1968 | Barkdoll | 197/82 X |
| 3,618,736 | 11/1971 | Abell et al. | 197/91 X |
| 3,677,386 | 7/1972 | Herterich et al. | 197/53 |
| 3,872,960 | 3/1975 | Gabor | 197/82 X |
| 3,963,109 | 6/1976 | Smith | 197/55 |

FOREIGN PATENT DOCUMENTS

| | | | |
|---|---|---|---|
| 2,141,193 | 4/1973 | Germany | 197/55 |
| 1,176,598 | 1/1970 | United Kingdom | 197/114 R |

*Primary Examiner*—Paul T. Sewell

*Attorney, Agent, or Firm*—Frederick A. Zoda; Alberry Sperry; John J. Kane

[57] ABSTRACT

A single element imprinting assembly of the disk, cylindrical or spherical type for use in typewriters and the like is provided with a stationary printing assembly having kinematically independent controls for character selection and imprinting movements of the printing element. The stationary printing assembly arrangement avoids the penalty of added moving mass when the mass of the character selection prime mover is increased. For the cylindrical and spherical types, the independent movement is achieved by three separate drive controls such that the axis of the tilt or lift control and the axis of the rotational drive control both perpendicularly intersect the axis of the imprinting drive control at separate points with universal joints or other constant speed couplings being located at each respective intersection thereby allowing independent and concurrent rotation, lift or tilt and imprinting modes of motion to attain higher printing speed. The printing speed is further increased by a multi-speed cam assembly synchronized with the constant-speed imprinting drive control to decrease imprinting delay when a near character is selected.

11 Claims, 7 Drawing Figures

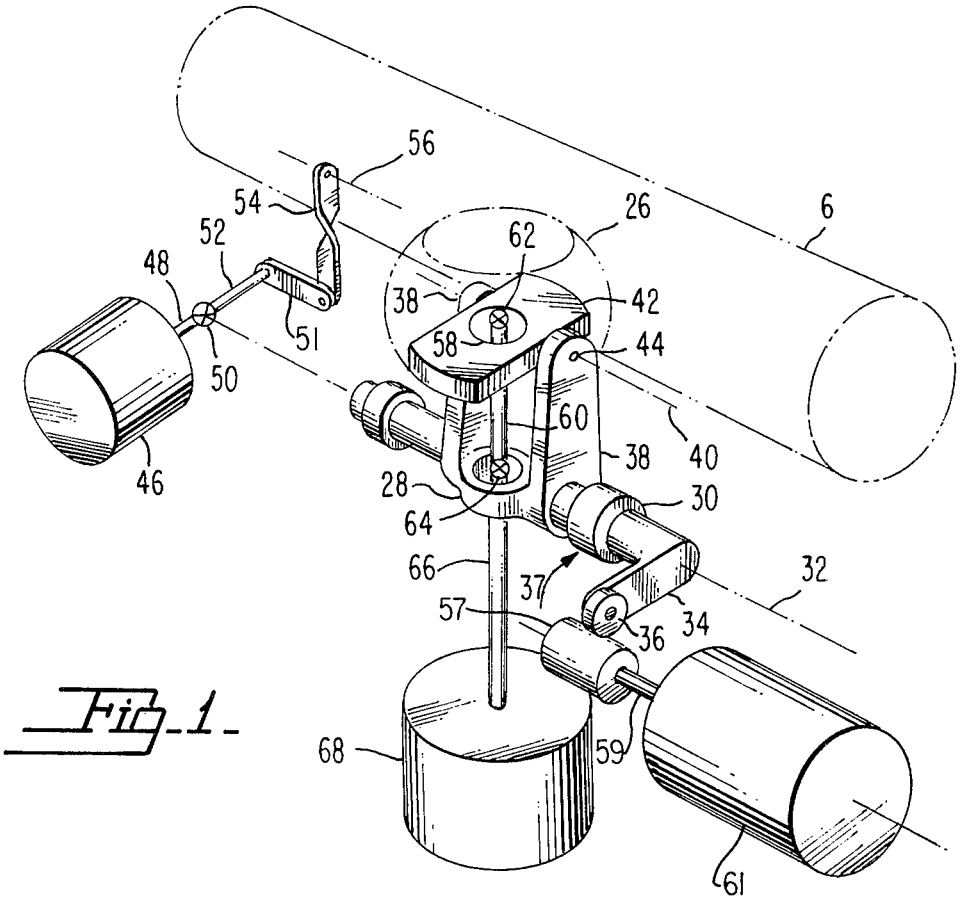
Fig. 1
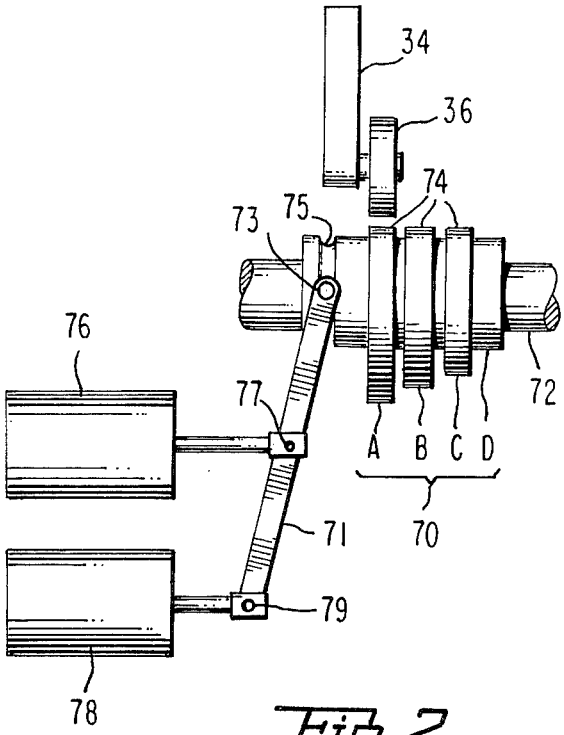
Fig. 2
Fig. 3
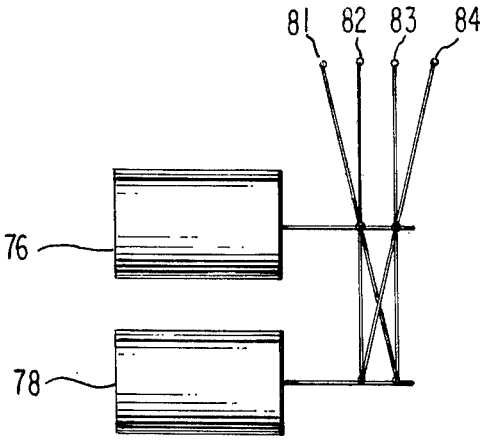

SINGLE ELEMENT IMPRINTING ASSEMBLY WITH INERTIALLY AND KINEMATICALLY INDEPENDENT MOTION CONTROLS

BACKGROUND OF THE INVENTION

1. Field of the Invention

This invention deals with serial impact printing assemblies for use in typewriters and other types of printing apparatus. In this field, the original practice was to utilize a multitude of typing bars, each having one or more of the possible characters driven sequentially into a fixed printing position. A massive platen is moved past the printing position through various mechanical means. High speed operation was inhibited by interfering flight paths of type bars and the high inertia of the movable platen due to cumbersome mechanical indexing mechanism. Printing quality was low because of the type bar flexibility and its lack of control at impact spot.

With the advent of the single element printer, the state of the art was pushed forward because it surpassed the bar type printer in speed and printing quality.

Single element printers generally fall in one of the following three types according to the arrangement of characters on the printer and thus the selection of characters during a printing cycle.

a. Disk (or daisy) type: The characters are placed on radially arranged individual cantilever arms forming a plane (and thus the name daisy) or a conical surface. Rotation accomplishes the character selection. Character imprinting is done by striking the character selected with an actuator or a ram mounted fixedly relative to the character selection motor.

b. Cylindrical type: The characters are arranged in two dimensional array on the cylindrical surface of the printing element. Character selection is accomplished by rotation and lift or drop of the printing element. Printing is performed by striking the printing element on to the platen.

c. Spherical type: The characters are arranged in two dimensional array on the spherical surface of the printing element. Character selection is accomplished by rotation and tilt about the center of the sphere.

As described below, when no distinction is made between the cylindrical and spherical types, "vertical" control or selecting refers to "lift" or "drop" of the former, and "tilt" of the latter. Also "drum" and "ball" will be used interchangeably with "cylindrical" and "spherical", respectively.

The present invention which applies to this more recent field of multi-character printing assemblies, utilizes a single printing element of either disk, cylindrical or spherical type.

The conventional arrangement between the single element imprinting assembly and the platen has been to move the entire imprinting assembly together with its various controls along the length of the platen during the printing of one line.

2. Description of the Prior Art

When utilizing the single printing element the prior art has always moved the single element and controls with respect to the platen rather than moving the platen with respect to the printing element.

The disk type printer has always included in the printer carrier the character selection motor, the imprinting prime mover and plunger or ram. The cylindrical and spherical printers have either employed mounting the character selection motor and imprinting motor on the printer carrier or resorted to transmitting the selection controls from stationary motors via flexible cables or metal bands. The consequence of all such arrangements is inertial interaction and dependence: i.e., an increase in power source or motor sizes for character selection and imprinting for the purpose of increasing printing speed would burden the carrier motor and decrease the overall printing speed. Auxiliary mechanisms such as ribbon movement that rode on the carrier further aggravated inertial dependence in such arrangements.

The stretching and deformation of the flexible control devices became less responsive or less reliable when higher printing speeds were attempted. Examples of the assemblies for using single element printing are shown in U.S. Pat. Nos. 2,757,775; 3,618,735; and 3,771,635. These ideas, along with many others in the prior art have been aimed at advancing the art within the confines of the existing configuration, which is plagued by inertial dependence. For the movable carrier configuration, the present state of development has reached to the point of sharp diminishing return and further increase of motor sizes has become prohibitive and unworkable.

SUMMARY OF THE INVENTION

The present invention utilizes a stationary single element printing assembly in conjunction with a laterally movable platen. The movable platen assembly is made light and responsive by a mechanically simple design which also lends itself to fully electrical controls.

For the disk type printer, the character selection and printing prime movers are made stationary so that their increase in bulk has no ill effect on the performance. For the cylindrical and spherical types the printing assembly is controlled by a linkage and prime mover assembly which allows for increased speed of operation through independence and decoupling of each movement mode with respect to all other movement modes. Character selection, imprinting, and character advancing ("escapement") can be performed independently of one another so that their respective prime movers can be chosen more massive to thereby increase the speed of each motion without penalizing one another.

Higher operation speed is achieved by isolation and motion independence between movement modes. When using the single printer element, independence of movement between rotation, tilt or lift, and imprinting are achieved in the present invention by the decoupling of each movement mode with respect to one another by a novel orientation of the respective axes of rotation which is maintained through a frame structure.

The orientation mandated by the frame keeps the rotational and tilting or lifting control shafts perpendicular to the printing axis or axis of rotation of the frame at all times. By using universal joints at the points of intersections of perpendicularity, each mode of motion is made independent of one another kinematically and inertially. To illustrate, in the printing stroke the output portions of the rotational and tilting or lifting shafts bend about the printing shaft through the use of universal joints without affecting the rotation and tilt or lift commands which may still be going on while the input portions and prime movers remain stationary.

In this manner the prime movers of rotation, tilt or lift, and imprinting can be chosen more powerful or massive without affecting or burdening one another or increasing the inertia of the output portions of the movements.

The frame includes a crank arm with a cam follower mounted thereon. A positioning mechanism is adapted to cause one or none of a group of cams located upon a camshaft to selectively contact the cam follower and thereby cause imprinting movement of the frame about its primary axis. The selection of a particular cam allows for more than one magnitude of imprinting force and more than one printing speed or frequency.

The speed and functioning characteristics of the laterally removable platen are improved by the use of a stationary prime mover such as a stepping or servo motor connected to the platen by pulley and cable means to cause horizontal movement thereof in response to the commands transmitted through the input keyboard. The vertical rotational movement or indexing of the platen is achieved by a worm mounted adjacent the platen, to mesh with a worm wheel which is rigidly attached to the end of the platen. The worm is driven by a stepping motor or rotary solenoid. Such worm and worm wheel arrangement allows fine resolution of movement to achieve all standard and non-standard line spacings and has the advantages of backlash-free, self-locking, easy and quiet reversal of rotation direction.

It is an object of this invention to eliminate printing movement inertia interdependence by making the housing of the printing assembly stationary and the platen movable.

It is another object of this invention to achieve independent controls of rotation, tilting or lifting and imprinting motions (i.e., kinematic independence) by a novel linkage arrangement.

It is another object of this invention to reduce the mass of the platen assembly and simplify the indexing mechanism by a novel worm wheel arrangement.

It is another object of this invention to increase the resolution of the indexing by a worm wheel arrangement.

It is another object of this invention to increase printing speed by synchronizing the variable character selection time to the constant speed periodical cam events.

It is another object of this invention to effect cam selection by a novel arrangement of binary-position devices and linkages with floating pivots.

It is another object of this invention to increase the character selection speed and full operating speed of an automatic printing assembly.

It is another object of this invention to provide a plurality of character printing speeds with a simple set of binary positioned selectors.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view showing the axial arrangement of the complete printing assembly and principal working elements;

FIG. 2 is a plan view of the cam and cam selection assembly;

FIG. 3 is a schematic representation of the cam selection mechanism;

DETAILED DESCRIPTION OF THE PREFERRED EMBODIMENT

Figure 5:
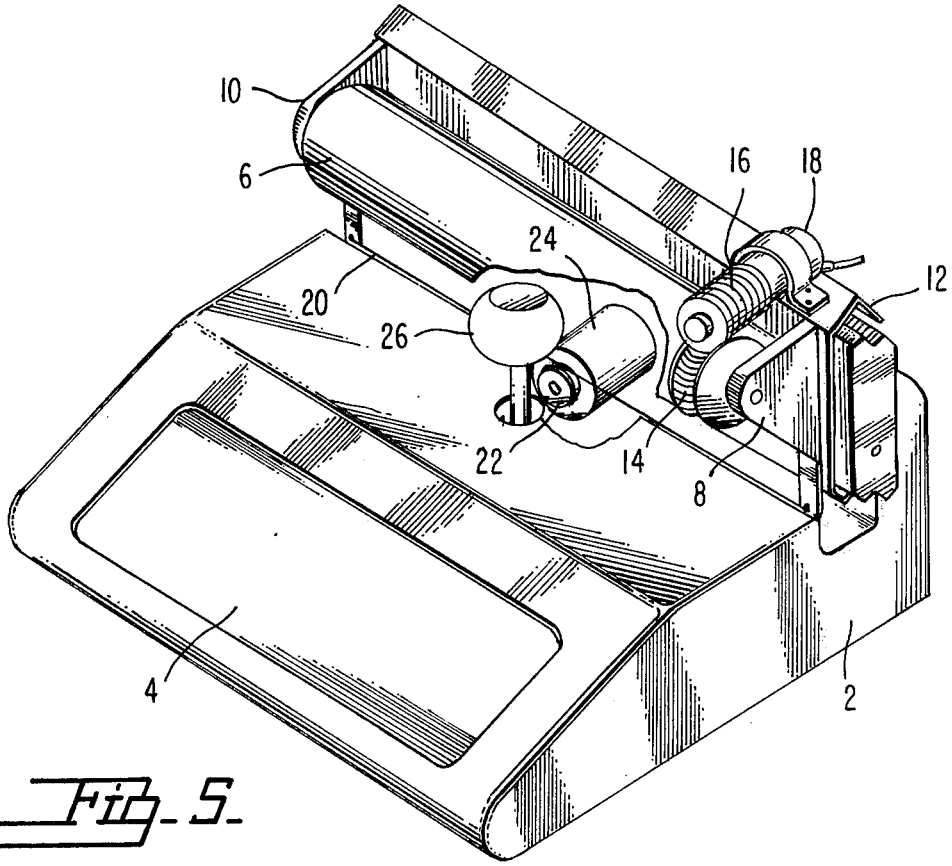
FIG. 5 is a perspective view of the entire assembly including the horizontal and vertical platen indexing controls showing spherical printing element.

A preferred embodiment of the present invention is schematically illustrated in FIG. 5 which shows the general printing command unit 2 and keyboard 4 which can be used as a conventional typewriter, an automatic typewriter or other varities of printing mechanisms such as computer printers. Through an electronic control system an input such as from keyboard 4 is executed to perform, electronically, character selection, imprinting or other movements.

Platen 6 is usually of cylindrical configuration and rotatably mounted between brackets 8 and 10. Bracket 12 is positioned to allow brackets 8 and 10 to be mounted thereon and provide a movable and rigid assembly for holding the platen 6. A worm wheel 14 may be mounted along one end of cylindrical platen 6 to provide rotational indexing for printing. Worm wheel 14 is adapted to be driven by a worm 16 which is driven by a worm drive means such as rotary solenoid or a stepping motor 18. By using these types of prime movers having fine resolution, indexing can be achieved in non-standard manners for variable or special spacing. This worm-gear arrangement also allows for self-locking of the system and an easily performed and yet quiet means of reversal of rotation.

Lateral escapement and return of platen 6 can be achieved by use of a wire means such as wire 20 which may be fixedly attached to both opposite ends of slidably mounted bracket 12. Wire 20 is adapted to be driven by pulley 22 which is fixedly mounted to a wire drive means such as motor 24. In this manner rotational movement of motor 24 is transmitted through pulley 22 and wire 20 into linear translation of platen 6. Preferably, motor 24 is of a stepping or servo type compatable with system parameters.

The basic mechanical simplicity of the movable assembly allows for quick and easy platen replacement and increased operating speed since lateral indexing will be performed by the platen and not by the imprinting assembly, which is already responsible for character selection.

For a single element printer head, the printing cycle comprises character selection and imprinting motions. For a spherical (26) or cylindrical type (27) printer head, this comprises rotation and vertical selection (i.e., tilting or lifting) for character selection since the characters are arranged in two dimensions on the type surface, and rocking of the printer assembly that strikes the printing surface of platen 6.

Figure 6:
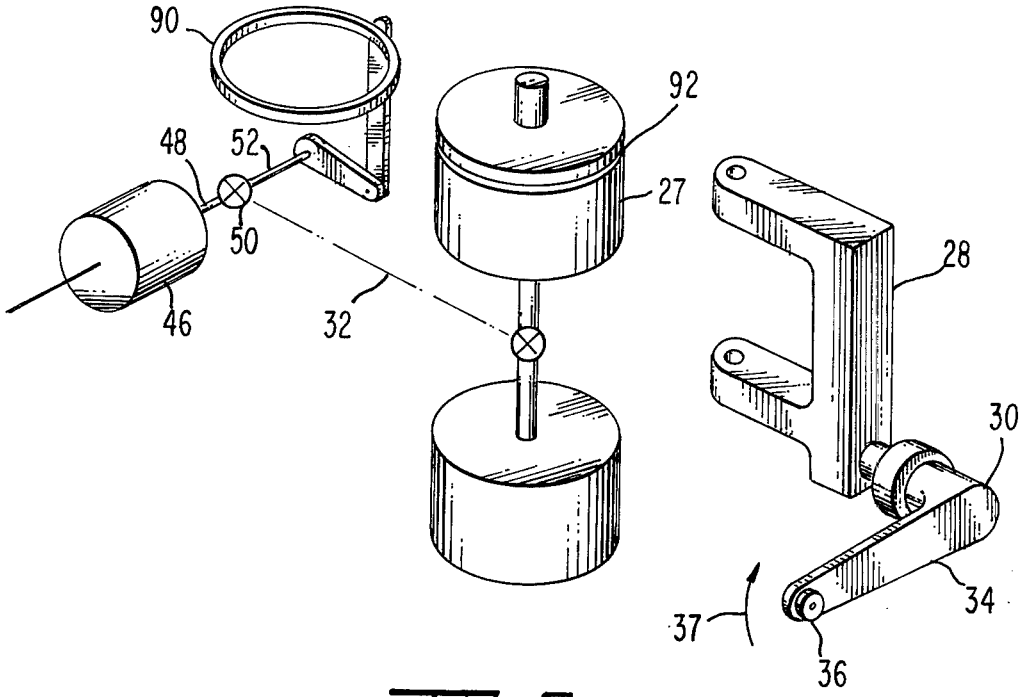
FIG. 6 is a schematic view of another embodiment of the present invention showing a cylindrical printing element.

It is a primary function of the present invention to decouple all modes of movement control from one another and thereby increase the available speed of operation of each movement without burdening one another to effect an overall operational speed increase. In this respect, a frame 28 maintains relative positions between the control linkage to achieve independence of control. Frame 28 is rotatably mounted in bearing elements which are schematically indicated as bearings 30. Rotation of frame 28 within bearings 30 is about a primary axis 32 which is the mode of movement responsible for imprinting. Frame 28 includes a crank arm portion 34 with a cam follower 36. Whenever cam follower 36 is urged upwardly as shown in FIGS. 1 and 6 by arrow 37, the frame 28 will rotate about primary axis 32 in a clockwise direction. This movement will cause type element 26 to strike the printing surface of platen 6. The upward movement of follower 36 for printing is caused by engagement of cam 57 therewith. Cam 57 is driven by imprinting prime mover or motor 61 and imprinting drive shaft 59.

Frame 28 can include a yoke section 38 as in FIG. 1 which extends from axis 32 to define a secondary axis 40 which is the tilt axis parallel to and displaced from primary axis 32. Mounted preferably within the yoke 38 and on the axis 40 is a platform 42. Platform 42 has pivot 44 extending laterally therefrom into opposite sides of yoke 38 and on axis 40 such that tilting movement of said platform is possible about axis 40. Type sphere 26 is attached to platform 42 such that tilting of platform 42 causes identical tilting of sphere 26. In this manner character selection of the particular desired row of characters can be achieved by the use of a means of control of the tilting of platform 42.

With a cylindrical type element 27 as shown in FIG. 6 the vertical movement for selection of the proper horizontal character row is accomplished by ring 90 which is positioned within groove 92 of cylindrical type element 27. When motor 46 is actuated, ring 90 will move vertically and thereby cause vertical movement of cylindrical type element 27 to position the desired horizontal row of characters adjacent platen 6 to be ready for imprinting.

Tilting of platform 42 and type sphere 26 can be achieved through a tilting drive source such as motor 46 and a tilting drive control means to connect the output of motor 46 to platform 42. Input command is transmitted from keyboard 4 to motor 46 defining the particular row of characters in which the desired character is located. Motor or vertical selecting prime mover 46 then preferably causes movement of linkage elements 48, 50, 52 and 54. Vertical selecting input shaft 48 causes rotational movement of coupling 50 which can be a single or double universal joint or other type of constant speed coupling which transmits the desired movement to vertical selecting output shaft 52, bell crank 51 and link 54. For the purpose of this invention a constant speed coupling is defined as any interconnecting joint between shafts wherein at all times the instantaneous rotational speed of the output shaft equals the instantaneous rotational speed of the input shaft regardless of the angular relationship between the intersecting axes of the shafts. Link 54 terminates at a pin 56 which is attached to platform 42. In this linkage assembly motor 46 has full control of the tilting movement of type sphere 26 in such a manner as to be entirely independent of the imprinting rotational movement about primary axis 32. This independence is achieved by the particular location chosen for linkage element 48, 50 and 52 with respect to axis 32. Shaft 48 and link 52 are positioned to be each perpendicular to axis 32 in space and to intersect each other and the coupling 50 at the primary axis 32. This arrangement effectively decouples the tilting mode of motion from the printing mode of motion of the type sphere 26, and allows for the choice of a more massive and therefore more quickly responsive motor for each mode of motion without burdening each other and allows for independent, concurrent control of each mode of motion to achieve the highest possible printing speed. Similar independence of motion is achieved with use of the cylindrical print element 27 since the decoupling joint 50 is positioned on axis of rotation 32.

Type sphere 26 is mounted upon platform 42 in such a manner as to be freely rotatable. To control this rotational movement platform 42 has defined therein a hole 58. Passing through hole 58 is shaft 60 which is attached to the geometric center of type sphere 26 at coupling or universal joint 62. Rotational movement of shaft 60 causes similar rotational movement of type sphere 26 without restricting the tilting movement imparted to the sphere by platform 42 due to the placement of coupling or universal joint 62. The other end of the shaft 60 has a coupling or a single or double universal joint 64 located thereon. Joint 64 is positioned to be on the primary axis 32 and such that shaft 60 is maintained perpendicular to axis 32 in space at all times. The other side of joint 64 is connected to output shaft 66 (which is also perpendicular to axis 32 spacially at all times) of a rotational control drive source such as motor or horizontal selecting prime mover 68. In this respect, actuation of motor 68 will cause rotation of type sphere 26 to the desired rotational orientation such that the desired column of characters is in a position for printing. The positioning of joint 64 on axis 32 and the orientations of shafts 60 and 66 being chosen each perpendicular to axis 32 effect a complete decoupling of the rotational mode of motion from the printing mode of motion of the type sphere 26. As a result of the above construction, each of the motions (rotation, tilt or lift, and imprinting) is made independent of one another. This decoupling allows the use of stationary massive drive motor for each mode of motion without burdening each other and allows for independent concurrent control of each mode of motion to achieve the highest possible printing speed.

Figure 7:
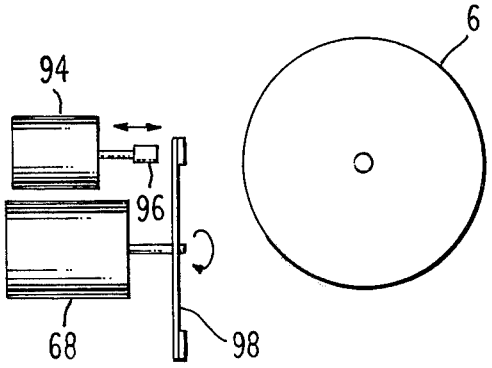
FIG. 7 is a schematic view of the disc printer element.

In the case of disk type printer (FIG. 7) character selection is done by the rotation of motor 68 and printing is accomplished by work of actuator 94 to drive the hammer 96 on to the back of the selected character of the printer type 98 in the customary way. By making the character selection motor 68 and printing prime mover 94 stationary (and the platen 6 movable) they can be made more massive and powerful for the purpose of increasing printing speed without burdening the lateral escapement prime mover.

In either type of printer (spherical, cylindrical, disk) operational speed is further increased by the use of a novel imprinting control mechanism. The printing cycle time of the single element printing assemblies has heretofore always been determined by the longest printing cycle required for the prime mover to bring the most remote character on the type head into position. Loss of time is apparent when a near character is printed since the character selection time is much less than that of the remote one.

This invention increases operating speed by grouping the possible alphanumeric characters into two or more groups according to their angular distance to the printing position and incorporating multiple printing speeds accordingly. For illustration, we shall only utilize two groups, the near and the far, or the fast and the slow respectively. Printing cycle or character selection time for each group is at a ratio of 1:2. Because of concurrency of selection and imprinting modes of motion, for practical purposes, printing cycle time and character selection time are used interchangeably here. An illustrative calculation below will show the increase in operation speed achieved by this scheme. We shall assume the printing speed of a conventional printer to be 30 cps which is determined by the slowest character. It is calculated that when the type characters of a typical type ball are grouped by the method just described, 80% of them fit into the fast group, or 80% usage of the type head can be operated at 60 cps with the existing prime mover. The average printing speed under the present invention would be (30 cps × 0.20) + (60 cps × 0.80) which equals an average operating speed of 52 cps.

Figure 4:
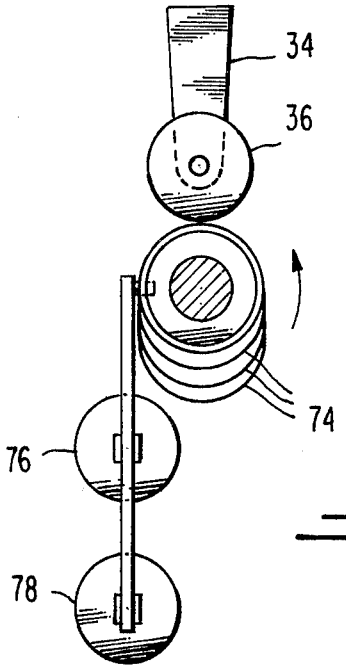
FIG. 4 is a side elevation view of the cam and cam selection assembly as shown in FIG. 2.

To implement multiple printing speeds in conjunction with the division of type characters into groups, a novel arrangement of cams is utilized as shown in FIGS. 2, 3, and 4. Cam follower 36 is positioned adjacent cam 70 which is keyed and movably axially on camshaft 72 to selectively abut follower 36 and thereby cause imprinting movement of frame 28. Alternatively, follower 36 can be movable axially on its own axis to selectively abut cam lobes 74. During operation the camshaft 72 will be constantly rotating with a cam cycle time which is an even divisor (i.e., integral fractions) of each of the grouped character selection time periods.

The selective engagement of cam 70 with follower 36 determines whether there is printing or non-printing action for each cycle of the cam. (Note that a cam cycle is one revolution of the cam shaft if it is single lobed, and a half revolution if it is double lobed, etc.) In the later case the cam is shifted to the neutral or non-printing position at which profile 74D is opposite follower 36. Further, profiles 74A, 74B and 74C which cause printing actions are designed to have different rises to impart different printing energy levels for different characters. To facilitate the shifting of cam 70 on shaft 72, a gap is provided between the follower 36 and the low spots on the cam profiles. By synchronizing the cam cycle time with character-to-character selection time maximum printing speed is achieved.

To achieve mechanically simple, light, and functionally fast and positive cam selection, floating link and binary position devices are used. Link 71, one end 73 of which is engaged in groove 75 in cam 70, has floating pivots 77 and 79 each attached to actuators 76 and 78, preferably of solenoid construction. By combination of positions of actuator 76 and 78, different cam positions and thus cam profiles can be selected (four in this example: 81, 82, 83, & 84 as shown in FIG. 3). Conventional positioning means, such as cam-lever combination, can also be used to position cam 70 or follower 36 to cause imprinting action.

While a particular embodiment of this invention is shown in the drawings and described above, it will be apparent, that many changes may be made in the form, arrangement and positioning of the various elements of the combination. In consideration thereof it should be understood that the preferred embodiment of the invention disclosed herein is intended to be illustrative only and not intended to limit the scope of the invention.

I claim:

1. A single element imprinting assembly with inertial and kinematic independent motion control means for use with a printing surface, which is movable with respect thereto, comprising:

a. a vertical selecting means comprising:
   1. a vertical selecting prime mover;
   2. a vertical selecting input shaft fixedly secured to said vertical selecting prime mover;
   3. a first coupling secured to said vertical selecting input shaft;
   4. a vertical selecting output shaft connected to said first coupling;
   5. a bell crank fixedly secured to said vertical selecting output shaft; and
   6. a connecting link connecting said bell crank to a single imprinting element tilt platform;

b. a rotational selecting means comprising:
   1. a rotational selecting prime mover;
   2. a rotational selecting input shaft fixedly secured to said rotational selecting prime mover;
   3. a second coupling secured to said rotational selecting input shaft;
   4. a rotational selecting output shaft connecting said second coupling to the single element imprinting rotation assembly; and c. imprinting means further comprising:
   1. an imprinting prime mover;
   2. an imprinting drive shaft fixedly secured to the output of said imprinting prime mover;
   3. an imprinting cam means mounted slidably keyed to said imprinting drive shaft so as to be rotatable therewith;
   4. a rocker frame rotatably mounted with the axis of rotation positioned perpendicular to the axes of rotation of said vertical selecting output shaft, said vertical selecting input shaft, said rotational selecting output shaft and said rotational selecting input shaft; said rocker frame adapted to effect printing and including:
      i. a crank arm and a cam follower secured to said crank arm to follow said imprinting cam means and be driven therefrom for imprinting; and
      ii. a yoke means for holding a single element imprinting assembly.

2. The assembly as defined in claim 1 wherein said first coupling comprises a constant speed coupling.

3. The assembly as defined in claim 1 wherein said first coupling comprises a single universal joint.

4. The assembly as defined in claim 1 wherein said first coupling comprises a double universal joint.

5. The assembly as defined in claim 1 wherein said second coupling comprises a constant speed coupling.

6. The assembly as defined in claim 1 wherein said second coupling comprises a single universal joint.

7. The assembly as defined in claim 1 wherein said second coupling comprises a double universal joint.

8. The assembly as defined in claim 1 further comprising a lifting ring secured to said connecting link to facilitate vertical indexing thereof.

9. The assembly as defined in claim 8 further comprising a drum-shaped single imprinting element which defines an annular groove therein to receive said lifting ring.

10. The assembly as defined in claim 1 further including:

a. a lateral drive means;
b. a drive pulley secured to the output of said drive means;
c. a drive wire fitted about said pulley and adapted to be driven therefrom;
d. a platen assembly fixedly secured to said drive wire and adapted to be driven therefrom to effect lateral indexing;
e. a vertical indexing means;

f. a vertical indexing worm fixedly secured to said vertical indexing means; and g. a vertical indexing worm wheel being fixedly secured to said platen and positioned in spaced relation for engagement with said vertical indexing worm to effect vertical indexing of said platen.

11. The assembly as defined in claim 9 further including:

a. a lateral drive means;

b. a drive pulley secured to the output of said drive means;

c. a drive wire fitted about said pulley and adapted to be driven therefrom;

d. a platen assembly fixedly secured to said drive wire and adapted to be driven therefrom to effect lateral indexing;

e. a vertical indexing means;

f. a vertical indexing worm fixedly secured to said vertical indexing means; and g. a vertical indexing worm wheel being fixedly secured to said platen and positioned in spaced relation for engagement with said vertical indexing worm to effect vertical indexing of said platen.

* * * * *